US005191356A

United States Patent [19]

Shibamiya

[11] Patent Number: 5,191,356

[45] Date of Patent: Mar. 2, 1993

[54] TOWER CONSERVING RECORDING APPARATUS

[75] Inventor: Yoshikazu Shibamiya, Tokyo, Japan

[73] Assignee: Canon Kabushiki Kaisha, Tokyo, Japan

[21] Appl. No.: 610,442

[22] Filed: Nov. 13, 1990

Related U.S. Application Data

[63] Continuation of Ser. No. 344,527, Apr. 26, 1989, abandoned, which is a continuation of Ser. No. 73,177, Jul. 14, 1987, abandoned.

[30] Foreign Application Priority Data

Jul. 18, 1986 [JP] Japan ..... 61-168029

[51] Int. Cl.[5] ..... B41J 2/325

[52] U.S. Cl. ..... 346/76 PH; 400/120

[58] Field of Search ..... 366/76 PH; 400/120

[56] References Cited

U.S. PATENT DOCUMENTS

| | | | |
|---|---|---|---|
| 3,114,902 | 12/1963 | Tanguy, Jr. | 340/259 |
| 4,113,391 | 9/1978 | Minowa | 400/120 |
| 4,407,003 | 9/1983 | Fukui | 346/76 PH |
| 4,409,600 | 10/1983 | Minowa | 346/76 PH |
| 4,429,318 | 1/1984 | Kobata | 346/76 PH |
| 4,434,354 | 2/1984 | Nakata | 346/76 PH |
| 4,719,473 | 1/1988 | Shimamura | 346/76 PH |

FOREIGN PATENT DOCUMENTS

| | | | |
|---|---|---|---|
| 51-3222 | 2/1976 | Japan . | |
| 57-57679 | 4/1982 | Japan . | |
| 0266269 | 11/1986 | Japan | 400/120 |

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

A recording apparatus such as a printer for recording an image such as characters and patterns on a recording medium which may be a heat-sensitive paper, ordinary paper or the like. The apparatus has a recording head adapted for making a relative movement with respect to the recording medium so as to record the image on the recording medium, the recording head being adapted to generate heat in a controlled manner thereby to record the image on the recording medium by the heat. The apparatus further has a record image density setting device for setting the density of the image to be recorded on the recording medium by varying, for example, recording voltage applied to the recording head, and a heat-generating period setting device for setting the period of heat generation in the recording head. The period of heat generation in the recording head and the recording speed are controlled in accordance with the value set by the record image density setting device.

25 Claims, 5 Drawing Sheets

Fig. 3

| VOLTAGE APPLIED TO THERMAL HEAD | CYCLE OF HEATING |
|---|---|
| $v_n$ | $\tau_n$ |
| $v_{n-1}$ | $\tau_{n-1}$ |
| $v_{n-2}$ | $\tau_{n-2}$ |
| $v_{n-3}$ | $\tau_{n-3}$ |
| | |
| | |
| $v_{i+1}$ | $\tau_{i+1}$ |
| $v_i$ | $\tau_i$ |
| $v_{i-1}$ | $\tau_{i-1}$ |
| | |
| $v_2$ | |
| $v_1$ | $\tau_1$ |
| $v_0$ | $\tau_0$ |

TOWER CONSERVING RECORDING APPARATUS

This application is a continuation of application Ser. No. 07/344,527 filed Apr. 26, 1989, now abandoned, which is a continuation of application Ser. No. 07/073,177 filed Sep. 14, 1987, abandoned.

BACKGROUND OF THE INVENTION

1. Field of the Invention

The present invention relates to a recording apparatus for recording an image on a recording medium. More particularly, the present invention is concerned with an image recording apparatus having a limited power source such as batteries.

The recording apparatus of the present invention is suitable for use in various apparatus such as electronic typewriters, desk-top calculators, word processors, copiers, printers, facsimiles and so on. The image which is handled by the recording apparatus of the present invention may be letters, numerals and/or patterns.

2. Related Background Art

Remarkable progress in the field of electronic engineering has made a great contribution to the reduction in the sizes of various electronic devices, which in turn has given a rise to the demand for devices having a high degree of portability. This applies also to the case of recording apparatus. Such portable recording apparatus essentially require a battery powered source. A typical example of a recording apparatus operable with battery power is a thermal printer which prints characters or patterns by locally heating a recording medium having a multiplicity of thermally developable dots of resistor. This type of printer is advantageous in that it enables the recording density to be freely controlled by varying the electric power supplied to the resistor. The control of the electric power source is usually conducted by means of so-called density adjusting dial which enables the electric power supplied to the resistor to be varied thereby effecting the control of the recording density. A high recording density requires correspondingly large electric power to be supplied to the resistor, with the result that the apparatus consumes a large amount of electric power and shortens the life of the battery.

SUMMARY OF THE INVENTION

Accordingly, an object of the present invention is to provide a recording apparatus which is capable of forming a clear image on the recording medium.

Another object of the present invention is to provide a recording apparatus which is capable of changing the density of image recorded on the recording medium.

Still another object of the present invention is to provide a recording apparatus capable of prolonging the life of battery used as the power source.

A further object of the present invention is to provide a recording apparatus in which, when the electric power supplied to the resistor is increased to cope with a demand for a higher recording density, the period of the supply of the electric power is correspondingly increased so as to maintain the mean electric power consumption of the whole apparatus regardless of the change in the recording density, thereby preventing any overloading of the battery power source and prolonging the life of the same.

To this end, according to the invention, there is provided a recording apparatus of the type in which the recording is conducted by heat produced by a recording head, comprising: recording density setting means; detection means for detecting the value set by the recording density setting means; heat-generating period setting means for setting the period of generation of heat from the recording head in accordance with the detection signal from the detecting means; and recording speed control means for controlling the recording speed in accordance with the value set by the heat-generating period setting means.

With this arrangement, the mean electric power consumption is maintained substantially constant even when the recording density is increased, so that the battery power source can serve for a longer time than in the conventional apparatus.

These and other objects, features and advantages of the present invention will become clear from the following description of the preferred embodiments when the same is read in conjunction with the accompanying drawings.

BRIEF DESCRIPTION OF THE DRAWINGS

FIG. 2, is an illustration of the construction of a memory for determining the heat generating period by controlling the application of a voltage;

DESCRIPTION OF THE PREFERRED EMBODIMENT

A preferred embodiment of the invention will be described hereinunder with reference to the accompanying drawings.

Figure 1:
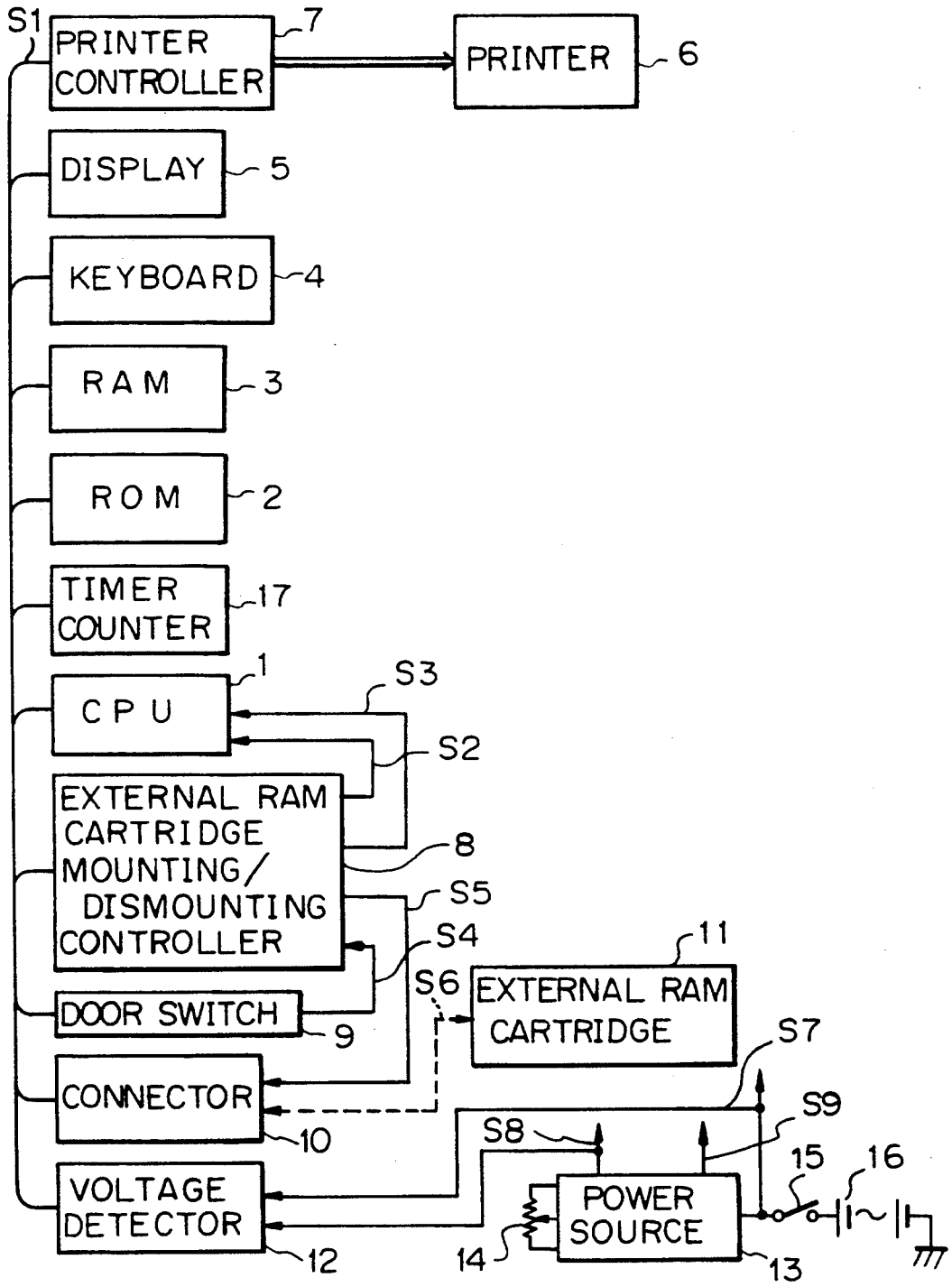
FIG. 1 is a block diagram of an embodiment of the recording apparatus in accordance with the present invention.
Figure 2:
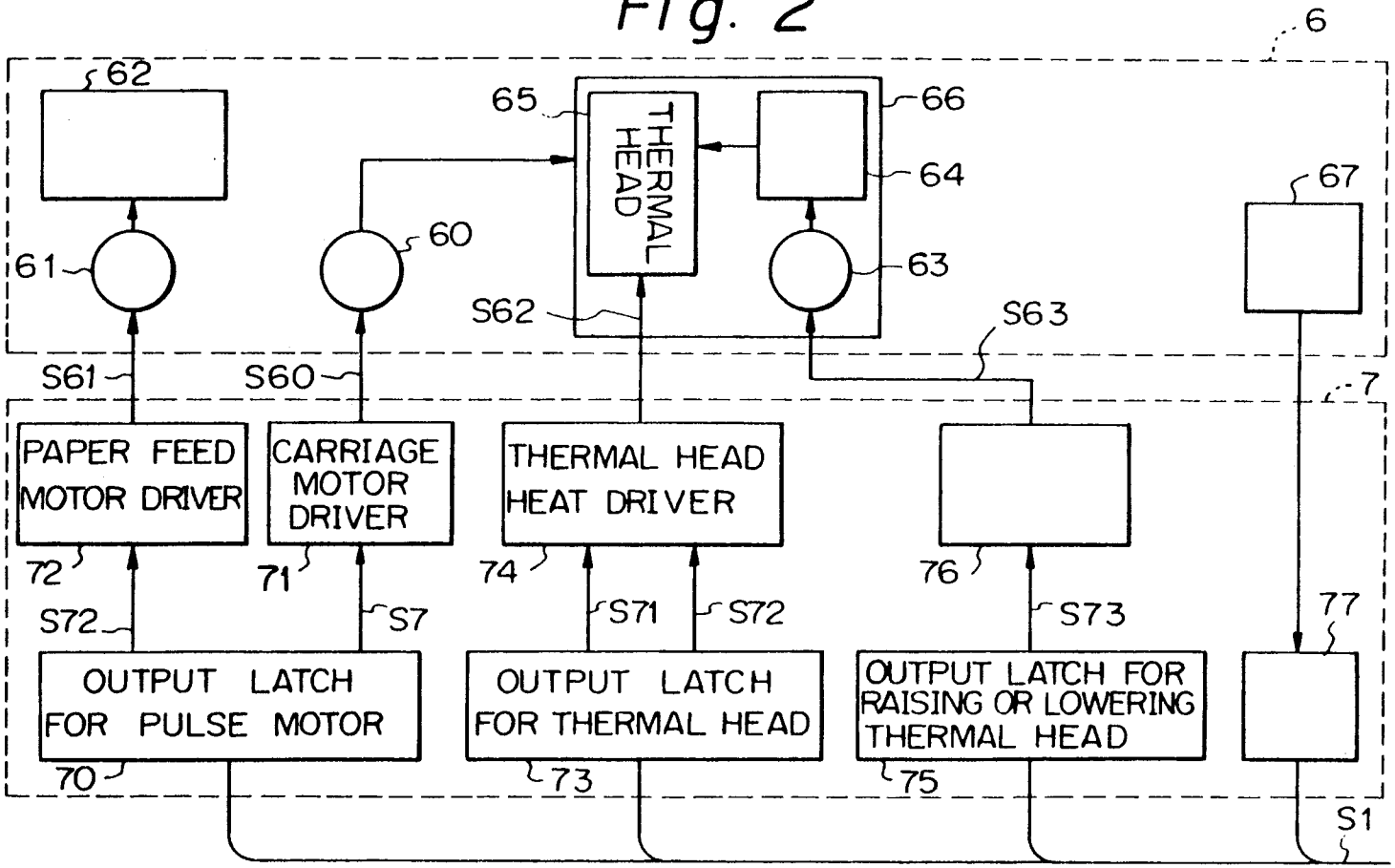
FIG. 2 is a block diagram showing the detail of a printer section and a printer control section of the recording apparatus shown in FIG. 1.

FIG. 1 is a block diagram of a battery-driven electronic typewriter as an embodiment of the recording apparatus in accordance with the present invention, while FIG. 2 is a block diagram showing the detail of a printer control section and a printer in the electronic typewriter shown in FIG. 1. Referring first to FIG. 1, a central processing unit (CPU) is adapted for reading a program command from a read only memory (ROM) 2 which will be detailed later, and for performing various computations necessary for typewriter functions thereby controlling various sections of the typewriter such as a keyboard 4, a display 5 and a printer controller 7.

The ROM 2 mentioned above stores various data such as a system program necessary for the operation of the CPU 1, character codes and dot patterns which are generally referred to as character generator CG and adapted to generate character codes and dot patterns for the printing, and a time table necessary used for controlling the operation of the printer and motors.

A random access memory (RAM) 3 is a read/write memory capable of storing data of operation of the CPU 1 executing the program command, results of the computing operation performed by the CPU 1, and character codes and data input from various sections such as the keyboard 4, a voltage detector 12 and so forth.

The keyboard 4 is an input device through which various data which are necessary in operations such as printing of characters, edition, and so forth.

A display 5 constitutes a display output device capable of displaying key data input through the keyboard 4 and data such as messages and symbols which are required by the operator.

As will be seen from FIG. 2, the printer 6 has a carriage control motor 60, paper feed control motor 61, paper-feed mechanism 62, thermal head raising/lowering D.C. motor 63, thermal head raising/lowering mechanism 64, thermal head 65, carriage 66, carriage left limiter sensor 67, and so forth. The printer is capable of performing various operations such as printing/raising and lowering of the print head, and paper feed, in accordance with instructions given by the printer controller 7.

The thermal head 65 has a plurality of heat-generating elements (not shown) which are adapted to be selectively energized to generate heat, and is held by the carriage 66 so as to be movable along a recording paper such as a heat-sensitive paper or an ordinary paper on which the characters are to be printed.

FIG. 2 also shows the detail of the printer controller 7. As will be seen from this Figure, the printer controller 7 has an output latch 70 for pulse motor, carriage motor driver 71, paper feed motor driver 72, output latch 75 for raising and lowering thermal head, D.C. motor driver for raising and lowering thermal head, and a left limiter detection input port 77. The printer controller 7 is adapted for controlling the operation of the printer 6 in accordance with control signals derived from the CPU 1.

A reference numeral 8 denotes an external RAM cartridge mounting/dismounting controller, adapted to control the CPU 1 and an external RAM cartridge 11 when such a cartridge is mounted on and dismounted from the body of the typewriter.

A door switch 9 is adapted to be held in an ON state during mounting or dismounting of the external RAM cartridge and otherwise in an OFF state.

A connector 10 provides a connection between the body of the typewriter and the external RAM cartridge mounted on the body of the typewriter.

The external RAM cartridge 11 stores, as is the case of the RAM 3, various data such as input character codes and is separable from the body of the typewriter. The external RAM cartridge 11 incorporates a RAM back-up power supply battery which is adapted to back-up the RAM so as to prevent the data stored in the RAM from being destroyed after dismounting of the RAM from the body of the typewriter. A voltage detector 12 is capable of detecting voltage levels of two systems which will be explained later.

A reference voltage 13 designates a power supply which is a simplified-type constant voltage power supply capable of forming, from the power of a battery 16, two different voltages namely, a voltage necessary for the driving of logic circuits such as the CPU 1, ROM 2, and RAM 3, and a voltage to be applied to the thermal head for the purpose of generating heat. The thermal head heating voltage can be varied by means of the variable resistor 14 for setting the printing density, thus enabling the printing density to be adjusted. The variable resistor 14 can be manually operated by the operator for attaining the desired printing density. The application of voltage to various motors can be conducted directly from the battery. A reference numeral 15 designates a power switch. The battery 16 mentioned above serves as the source of energy with which this typewriter operates.

A reference numeral 17 designates a loadable timer counter capable of counting up and down at a predetermined time interval. The CPU 1 reads and writes data from and into this counter.

Exchange of data between various sections such as CPU 1, ROM 2, RAM 3, printer controller 7 and so forth is conducted through a group of signal lines which are represented as a single BUS S1.

A symbol S2 represents an external interruption signal which interrupts the operation of the CPU 1 when the level thereof changes from "0" to "1".

A symbol S3 represents HALT signal line. The CPU 1 operates when the level of this line is "0" but stops operation when the level of this signal is "1". A symbol S4 represents a signal line through which a signal is transmitted to the cartridge mounting/dismounting controller 8 so as to inform the latter of the state of the door switch 9, i.e., whether it is in an ON state or an OFF state. A symbol S5 represents a control signal for controlling a chip enable signal of the RAM in the cartridge 11 during mounting and dismounting of the cartridge 11. A symbol S6 represents a group of signal lines for electrically connecting the external RAM cartridge to the body of the typewriter thereby to enable the external RAM cartridge to operate. The BUS 1 mentioned before is partly included in this signal lines. The battery voltage and the thermal head heating voltage are respectively represented by S7 and S8. Both voltages are detectable by the voltage detector 12. The power source voltage for logic circuits is represented by S9.

Figure 4:
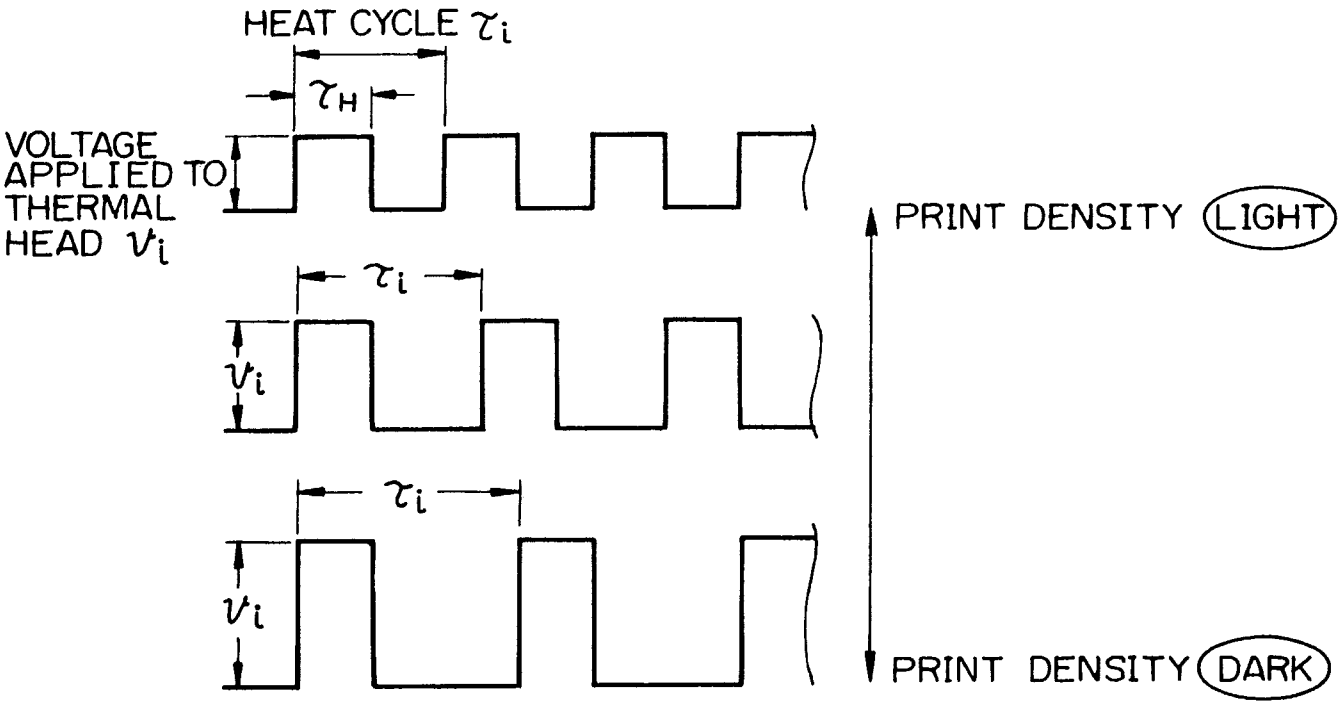
FIG. 4 is a diagram showing the relationship between the applied voltage and the heat-generating period.

FIG. 3 shows a heat-generating period setting table constituting a part of the memory structure in the ROM 2. This table contains data concerning the heat-generating period $\tau_i$ which enables the power consumption to be maintained substantially constant despite any change in the voltage $v_i$ supplied to the thermal head. The data is obtained through experiments. The relationship between the thermal head voltage $v_i$ and the heat-generating period $\tau_i$ is shown in FIG. 4. It will be seen that the duration $\tau_H$ of the heating voltage $v_i$ is constant regardless of the level of the voltage. However, the period of heat generation, i.e., the time interval between two successive heating voltages is increased when the voltage applied to the thermal head is increased to attain a higher recording density.

In operation, as the power switch 15 on the electronic typewriter is turned on, voltages S7 to S9 rise and the CPU 1 conducts various initializing operations such as clearing of the work area in the RAM 3, setting of the display 5, return of the carriage on the printer to the left margin, raising of the thermal head, and so forth. Input through the keyboard 4 starts as the initializing operations are over. In response to the key data, the CPU 1 operates to display the key data on the CPU 1 and, while controlling the printer 6 through the printer controller 7, thereby printing the key data.

Figure 5:
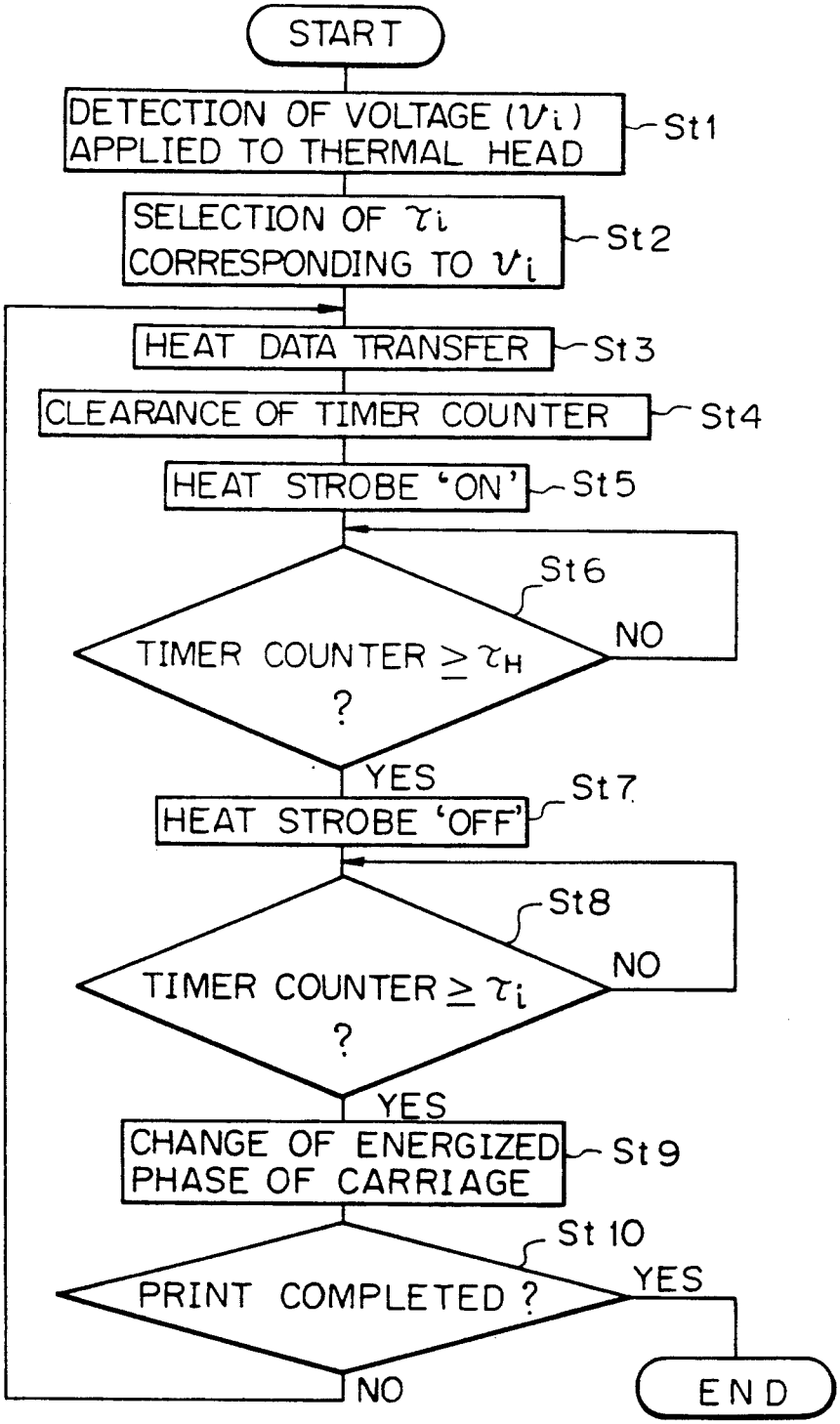
FIG. 5 is a flow chart showing the printing operation performed by the embodiment shown in FIG. 1.

A description will be made hereinunder as to the printing routine performed in the recording apparatus in accordance with the present invention, with specific reference to FIG. 5.

In the first step St1 of the printing routine, the CPU 1 detects the thermal head voltage $v_i$ through the voltage detector 12. In this state there is no substantial fluctuation in the source voltage because no load is applied to the power source, so that the voltage $v_i$ set by the printing density setting variable resistor 14 can be detected with a high degree of accuracy. Then, in step St2, the heat-generating period $\tau_i$ corresponding to the detected voltage $v_i$ is determined from the heat-generating period setting table shown in FIG. 3.

Then, a dot pattern to be printed is delivered to the output latch 73 for the thermal head as shown in FIG. 2. Then, the timer counter 17 is cleared in step St4 and heat strobe S72 is turned on. In consequence, only the dots which are latched as "1" in the thermal head output latch 73 are supplied with the electric power and these dots generate heat thereby print the required dot pattern in step St5. Then, as the content of the timer counter reaches a predetermined value $\tau_H$ in step St6, the heat strobe is turned off in step St7. This value $\tau_H$ is constant regardless of any change in the thermal head voltage $v_i$. In step St8, the content of the timer counter reaches $\tau_i$ which has been set in accordance with the voltage $v_i$ as explained before. Then, in step St9, an exciting phase change-over signal is sent to the pulse motor output latch 70 thereby to cause the carriage to be fed by a distance corresponding to one dot through the carriage motor driver 71. If the printing operation is to be continued, the next heat data is transmitted to enable the printer to continue the printing and the operation is ceased in step St 10 as the printing is finished.

Thus, in the recording apparatus of the present invention, both the heat generating period of the thermal head 65 and the printing speed, i.e., the velocity of movement of the thermal head 65 along the recording paper, are controlled in accordance with the value set by the printing density setting variable resistor 14.

When the voltage applied to the thermal head has been increased for the purpose of attaining a higher recording density, the control is made such as to increase the heat-generating period in a certain relation to the thermal head voltage so as to prolong the period of switch-over of the phase excitation of the carriage motor, whereby the mean power consumption of the recording apparatus is decreased to compensate for the increase in the power consumption due to the increased voltage. Therefore, the power consumption of the recording apparatus is maintained substantially constant. At the same time, the loss of electric power due to the internal resistance of the battery can be reduced thanks to the increased period of switch-over of the phase excitation. For these reasons, the life of the battery is prolonged advantageously. In addition, the increased period of switch-over of the phase excitation of the pulse motor increases the torque of the pulse motor, so that unfavorable synchronization failure which may otherwise be caused by a reduction in the voltage of the battery can be avoided. This also contributes to the economical use of the electric power and, hence, a prolonged life of the battery.

In the described embodiment of the recording apparatus, the adjustment of the recording density is effected by varying the voltage applied to the thermal head. This, however, is not exclusive and the control of the density of recording may be effected by varying, the heat strobe time instead of the thermal head voltage. In such a case, when the strobe time, i.e., the power, supplied to the thermal head is increased for the purpose of attaining a higher recording density, the time interval until the next cycle of application of the voltage is increased to attain a longer life of the battery.

It is to be understood that, though the recording speed is controlled in the described embodiment by varying the period of switch-over of phase excitation of a pulse motor for driving the carriage, this is not exclusive and the arrangement may be such that the carriage is driven by a servomotor which operates at a speed determined upon consultation with a speed reference table which is beforehand set in the ROM and which stores various values of speed in relation to the thermal head voltage which is to be detected by the voltage detector.

The described embodiment of the recording apparatus is a so-called serial printer in which the thermal printer moved reciprocatingly along the recording paper on which the characters are to be printed. This, however, is only illustrative and the invention may be applied to various types of recording apparatus in which the printing relies upon a relative movement between a recording medium and a recording head. For instance, it is also possible to apply the invention to a so-called full-line type printer in which a linear thermal head is disposed over the entire length of the printing line. In case of the full-line type printer, the recording speed appears as the movement of the recording medium with respect to the stationary recording head.

It will also be clear to those skilled in the art that the invention is applicable both to a recording apparatus having a so-called thermal-transfer type printer in which an ink tape carrying an ink is selectively heated by a recording head so as to transfer the ink to the recording medium, and recording apparatus having a so-called heat-sensitive type printer in which a heat-sensitive recording medium is selectively heated by the recording head, thereby directly printing data. Thus, various types of recording medium such as heat-sensitive papers, ordinary papers, plastic sheets for OHPs and so forth can be used in accordance with the subject information.

I claim:

1. A recording apparatus for recording an image on a recording medium, comprising:

a recording head adapted for movement relative to said recording medium so as to record the image on said recording medium, said recording head generating heat in a controlled manner thereby to record on said recording medium;

voltage detecting means for detecting a voltage applied to said recording head to cause said recording head to generate heat;

record image density setting means for setting a value of the density of the image to be recorded on said recording medium;

detecting means for detecting the value set by said record image density setting means and providing a corresponding detection signal;

heat-generating period setting means responsive to said detecting means for setting the period of heat generation in said recording head in response to the voltage applied to said recording head;

recording speed setting means responsive to said detecting means for setting the speed of recording by said recording head in accordance with said detection signal from said detecting means;

an electric power source to supply electric power to cause said recording head to generate heat in accordance with said heat-generating period setting means and to move said recording head relative to said recording medium in accordance with said recording speed setting means; and control means for controlling the heat generating period and the recording speed of said recording head in response to a set value by said record image density setting means, said control means controlling said heat generating period and said recording speed of said recording head in such a manner that an average electric power consumption is substantially constant when said heat generating period and said recording speed of said recording head are controlled.

2. A recording apparatus according to claim 1, wherein said recording head moves across said recording medium.

3. A recording apparatus according to claim 2, wherein said recording head moves across said recording medium at a speed which varies in response to the detection signal from said detection means.

4. A recording apparatus according to claim 1, wherein said recording head produces heat by electric power supplied from a battery power source.

5. A recording apparatus according to claim 1, wherein the movement of said recording head is effected by a pulse motor.

6. A recording apparatus according to claim 1, wherein the movement of said recording head is effected by a servo motor.

7. A recording apparatus according to claim 1, wherein said control means has a table for determining said heat generating period and said recording speed of said recording head in such a manner that the electric power supplied from said electric power source is equal to or less than a predetermined value.

8. A recording apparatus as in claim 1 wherein said electric power source further comprises a battery.

9. A recording apparatus as in claim 8 wherein said average power consumption is kept substantially constant in response to an interval resistance of said battery.

10. A recording apparatus for recording an image on a recording medium, comprising:

a recording head relatively moving with respect to said recording medium to record said image on said recording medium by generating heat;

voltage detecting means for detecting a voltage applied to said recording head to cause said recording head to generate heat;

recording image density setting means for setting a value of the density of the image to be recorded on said recording medium;

detecting means for detecting the value set by said record image density setting means and providing a corresponding detection signal;

heat-generating period setting means for setting the period of heat generation in said recording head in response to the voltage applied to said recording head;

recording speed setting means for setting the speed of recording by said recording head in response to said detection signal from said detecting means;

an electric power source to supply electric power to cause said recording head to generate heat in accordance with said heat-generating period setting means and power to move said recording head relative to said recording medium in accordance with said recording speed setting means; and control means for controlling the heat generating period and the recording speed of said recording head in response to a set value by said record image density setting means, said control means controlling said heat generating period and said recording speed of said recording head in such a manner that an average electric power consumption is substantially constant when said heat generating period and said recording speed of said recording head are controlled.

11. A recording apparatus according to claim 10, wherein said recording head moves across said recording medium.

12. A recording apparatus according to claim 7, wherein said recording head moves across said recording medium at a speed which varies in response to the detection signal from said detection means.

13. A recording apparatus according to claim 10, wherein said recording head produces heat by electric power supplied from a battery power source.

14. A recording apparatus according to claim 10, wherein the movement of said recording head is effected by a pulse motor.

15. A recording apparatus according to claim 10, wherein the movement of said recording head is effected by a pulse motor.

16. A recording apparatus according to claim 10, wherein said control means has a table for determining said heat generating period and said recording speed of said recording head in such a manner that the electric power supplied from said electric power source is equal to or less than a predetermined value.

17. A recording apparatus as in claim 10 wherein said electric power source further comprises a battery.

18. A recording apparatus as in claim 18 wherein said average power consumption is kept substantially constant in response to an internal resistance of said battery.

19. A recording apparatus for recording an image on a recording medium, comprising:

an electric power source;

a recording head relatively moving with respect to said recording medium to record an image on said recording medium, said recording head having a plurality of heat generating elements;

voltage detecting means for detecting a voltage applied to said recording head to cause said recording head to generate heat;

image density setting means for setting a value of the density of the image to be recorded on said recording medium; and control means for controlling a heat generating period and a recording speed of said recording head in response to said set value set by said record image density setting means and said recording head voltage, said control means controlling said heat generating period and said recording speed of said recording head in such a manner that an average electric power consumption is substantially constant when said heat generating period and said recording speed of said recording head are controlled.

20. A recording apparatus according to claim 19, wherein said control means has a table for determining said heat generating period and said recording speed of said recording head in such a manner that the electric power supplied from said electric power source is equal to or less than a predetermined value.

21. A recording apparatus as in claim 19 wherein said electric power source further comprises a battery.

22. A recording apparatus as in claim 21 wherein said average power consumption is kept substantially constant in response to an internal resistance of said battery.

23. A recording apparatus for recording light and deep density images on a recording medium by utilizing heat, said apparatus comprising:

a movable recording head for recording on said recording medium by utilizing heat to deposit an ink thereon;

moving means for relatively moving said recording head and said recording medium;

an electric voltage source for supplying an electric voltage in accordance with an image data inputted to drive said recording head, said electric voltage also being used to relatively move said recording head and said recording medium; and control means for controlling said electric voltage, said control means controlling a recording electric power consumed by said recording head when said recording head is recording and a conveyance electric power consumed by said moving means to relatively move said recording head and said recording medium, said recording electric power and said conveyance electric power being controlled so that an average consumption electric power is substantially the same for recording light density images and deep density images.

24. An apparatus according to claim 23, wherein an application time period of said electric voltage supplied to said recording head for recording light and deep density images is constant, and when recording is effected for deep density images said electric voltage to be applied to said recording head is greater and a time period until a next application of said electric voltage is longer, and when recording is effected for light density images said electric voltage to be applied to said recording head is smaller and a time period until a next application of said electric voltage is shorter, and wherein a time period of the relative movement between said recording head and said recording medium is longer when recording deep density images and shorter when recording light density images so that an average consumption electric power is substantially the same for recording light density images and deep density images.

25. An apparatus according to claim 23, wherein said voltage supplied to said recording head when recording light and deep density images is constant, and when recording is effected for deep density images a time period said for which said electric voltage is to be applied to said recording head is longer and a time period until a next application of said electric voltage is longer, and when recording is effected for light density images the time period for which said electric voltage is to be applied to said recording head is shorter and a time period until a next application of said electric voltage is shorter, and wherein a time period of the relative movement between said recording head and said recording medium is longer when recording deep density images and shorter when recording light density images so that an average consumption electric power is substantially the same for recording light and deep density images.

* * * * *

UNITED STATES PATENT AND TRADEMARK OFFICE

CERTIFICATE OF CORRECTION

PATENT NO. : 5,191,356

DATED : March 2, 1993

INVENTOR(S) : YOSHIKAZU SHIBAMIYA

It is certified that error appears in the above-identified patent and that said Letters Patent is hereby corrected as shown below: Title page:

AT [54] TITLE

"TOWER" should read --POWER--.

COLUMN 1

Line 1, "TOWER" should read --POWER--.

COLUMN 2

Line 28, "FIG. 2," should read --FIG. 3--.
Line 33, "flow chart" should read --flowchart--.
Line 60, "necessary" should read --necessary and--.

COLUMN 3

Line 58, "voltages" should read --voltages,--.

COLUMN 5

Line 13, "thereby" should read --thereby to--.
Line 62, "varying," should read --varying--.

COLUMN 6

Line 14, "moved" should read --moves--.

UNITED STATES PATENT AND TRADEMARK OFFICE

CERTIFICATE OF CORRECTION

PATENT NO. : 5,191,356

DATED : March 2, 1993

INVENTOR(S) : YOSHIKAZU SHIBAMIYA

It is certified that error appears in the above-identified patent and that said Letters Patent is hereby corrected as shown below:

COLUMN 7

Line 28, "servo motor." should read --servo-motor.--.
Line 35, "claim 1" should read --claim 1,--.
Line 37, "claim 8" should read --claim 8,--.
Line 39, "interval" should read --internal--.

COLUMN 8

Line 31, "claim 10" should read --claim 10,--.
Line 33, "claim 18" should read --claim 17,--.
Line 67, "claim 19" should read --claim 19,--.

COLUMN 9

Line 1, "claim 21" should read --claim 21,--.

Signed and Sealed this

Sixth Day of July, 1993

*Attest:*

Michael K. Kirk

MICHAEL K. KIRK

*Attesting Officer*

*Acting Commissioner of Patents and Trademarks*